US009875867B2

(12) United States Patent
Marchand et al.

(10) Patent No.: US 9,875,867 B2
(45) Date of Patent: Jan. 23, 2018

(54) ELECTRONIC SWITCH FOR SIMULATING A MECHANICAL ROCKER SWITCH

(71) Applicant: THOMSON LICENSING, Issy de Moulineaux (FR)

(72) Inventors: Philippe Marchand, Vitre (FR); Philippe Launay, Rennes (FR); Philippe Guillot, Bruz (FR)

(73) Assignee: Thomson Licensing (FR)

( * ) Notice: Subject to any disclaimer, the term of this patent is extended or adjusted under 35 U.S.C. 154(b) by 312 days.

(21) Appl. No.: 14/625,221

(22) Filed: Feb. 18, 2015

(65) Prior Publication Data

US 2015/0235788 A1 Aug. 20, 2015

(30) Foreign Application Priority Data

Feb. 19, 2014 (FR) ..... 14 51328

(51) Int. Cl.
*H01H 3/28* (2006.01)
*H01H 23/02* (2006.01)

(52) U.S. Cl.
CPC ..... *H01H 23/02* (2013.01); *Y10T 307/977* (2015.04)

(58) Field of Classification Search
CPC ..... H01H 23/02
See application file for complete search history.

(56) References Cited

U.S. PATENT DOCUMENTS

| | | | | |
|---|---|---|---|---|
| 3,510,689 | A | 5/1970 | Baker | |
| 4,047,057 | A | 9/1977 | Ahmed | |
| 5,138,186 | A | 8/1992 | Dumbovic | |
| 2002/0125867 | A1 * | 9/2002 | Choo | H02M 3/33561 323/282 |

FOREIGN PATENT DOCUMENTS

| | | |
|---|---|---|
| EP | 2056323 | 5/2009 |
| EP | 2626993 | 8/2013 |

(Continued)

OTHER PUBLICATIONS

Search Report Dated Oct. 6, 2014.

(Continued)

*Primary Examiner* — Daniel Puentes
(74) *Attorney, Agent, or Firm* — Jack Schwartz & Associates, PLLC

(57) ABSTRACT

The present disclosure relates to an electronic switch for simulating a mechanical rocker switch having a determined current-interrupting capacity, the electronic switch being configured to supply power to an electronic device using an input voltage, and comprises a tact switch for the generation of a control signal, a bistable circuit whose output state depends on said control signal, a switching circuit adapted to the opening and to the closing of a power supply line supplying power to the device, which device consumes a current less than or equal to said determined interrupting capacity, a memory circuit comprising a reservoir capacitor, the tact switch being configured to control opening and closing of the switching circuit and the memory circuit being adapted to the storage of an "open" or a "closed" mechanical position of the electronic switch for a predetermined duration according to the reservoir capacitor.

15 Claims, 1 Drawing Sheet

(56) References Cited

FOREIGN PATENT DOCUMENTS

| | | |
|---|---|---|
| FR | 2942074 | 8/2010 |
| WO | WO2014034264 | 3/2014 |

OTHER PUBLICATIONS

"Official Journal of the European Union L225", Commission Regulation (EU) No. 801/2013, Commission Implementing Regulation (EU) No. 802/2013, Commission Implemeting Regulation (EU) No. 803/2013, ISN1977-0677, vol. 56, Aug. 23, 2013.

"Official Journal of the European Union L339/45" Commission Regulation (EC) No. 1275/2008, Implementing Directive 2005/32/EC of the European Parliament and of the Council with regard to ecodesign requirements for standby and off mode electric power consumption of electrical and electronic household and office equipment, Dec. 17, 2008.

* cited by examiner

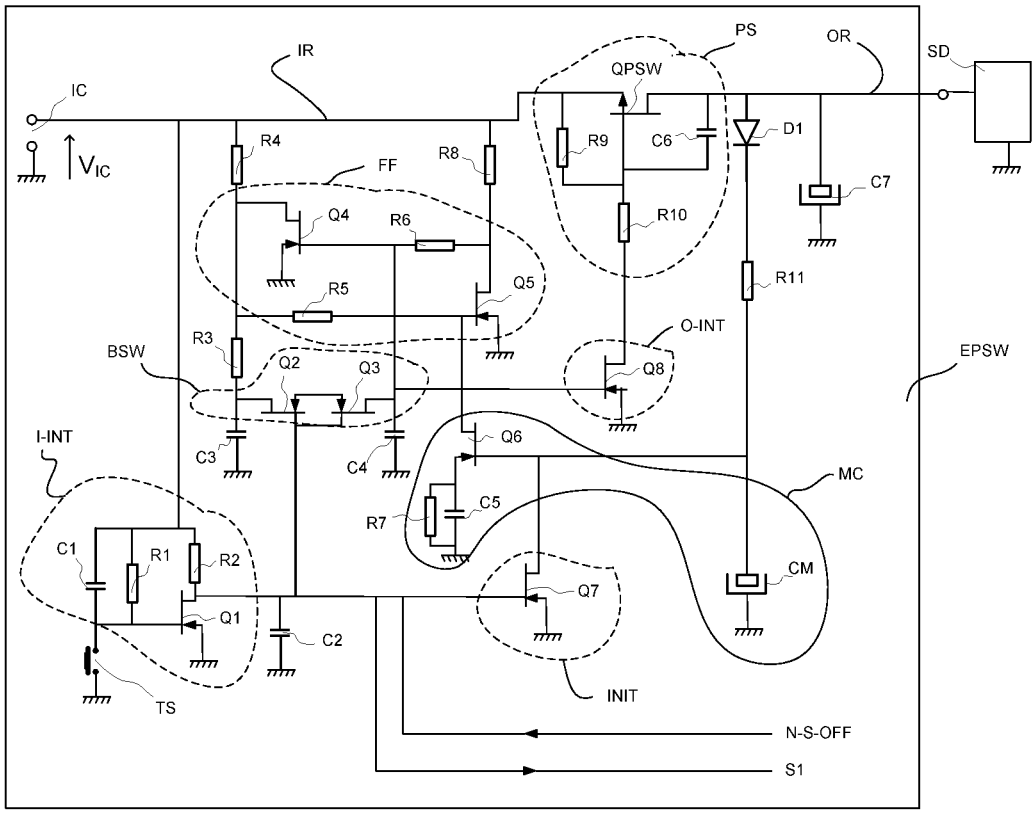
IC
$V_{IC}$
IR
R4
FF
Q4
R6
R5
Q5
R8
PS
QPSW
R9
C6
D1
OR
SD
C7
R10
R11
O-INT
Q8
EPSW
R3
BSW
Q2
Q3
C3
C4
Q6
MC
I-INT
C5
R7
C1
R1
R2
Q1
C2
Q7
CM
TS
INIT
N-S-OFF
S1

ELECTRONIC SWITCH FOR SIMULATING A MECHANICAL ROCKER SWITCH

This application claims the benefit, under 35 U.S.C. §119 of French Patent Application No. 1451328, filed Feb. 19, 2014.

FIELD

The disclosure relates to the field of power switches and more specifically to that of electronic switches.

BACKGROUND

Devices powered by an external power supply module of "DC pack" type are traditionally switched on or off using a mechanical switch such as a rocker switch or a push switch, which retain the position they are given until operated again by a user. These mechanical switches are chosen in order to offer interrupting capacity characteristics sufficient to avoid causing an electric arc, damaging and then gradually destroying the contacts at the opening of the circuit. Despite this, a mechanical switch has a limited operating life generally defined in number of cycles of opening and closing. For example, a mechanical rocker switch can have an average number of cycles of 25,000 openings and closings before there is a risk of harmful damage to its contacts.

An alternative consists in using a mechanical switch whose current characteristics are only a few tens of milliamperes and using this component in a control circuit for a MOSFET power transistor which will act as a high interrupting capacity switch capable of being crossed by a high load current.

These mechanical solutions have the advantage of disconnecting the powered item of equipment from the power supply rail and of guaranteeing the absence of residual current when a powered device is configured in an "off" or more precisely a "powered off" mode.

They nevertheless have disadvantages, notably:

- the price of a mechanical solution is substantially higher than that of an electronic solution,
- the gradual and inevitable wearing of the contacts,
- the fact that it is impossible to control these switches using embedded software except by using a relay or bistable relay, but this solution appears unsuitable in the case of powering electronic devices, such as, for example, audiovisual programme receiver-decoders, or network gateways.

The main advantages of mechanical rocker switches or mechanical push switches are their ease of use and the position memory effect, since, once positioned in "on" or "off" mode, they retain their position until operated again.

For the implementation of the memory effect, solutions exist which comprise a tact switch (also called a micro-switch) coupled to a MOSFET and to a control unit with microcontroller, having a non-volatile memory. The microcontroller in this case records the position of the power supply circuit ("on" or "off"). However, this solution requires restarting the entire system, after an unexpected disappearance of the power supply current, in order to define which state is stored in the memory and reconfigure the system to "off" mode, if necessary.

This solution requires an almost-permanent state of activation of the microcontroller in order to read the memory and monitor the state of the micro-switch, which results in an energy consumption which is non-negligible and disadvantageous with respect to the maximum values appearing in European Directive 1275/2008 relating to power consumption of equipment in standby mode.

In addition, and in the case of a mechanical solution, a request for a complete switching off cannot be made remotely (via a remote control) or by programming (on detection of an expiry of a timer or of a predefined event).

In addition to the additional cost it incurs, the mechanical switch appears more difficult to incorporate into a cosmetic "front face" of an item of equipment. A software-controlled solution resolves this type of problem, but on the other hand requires a disconnection and reconnection to the mains network in the event of malfunctioning related to a software "crash".

The solutions mentioned all have disadvantages.

SUMMARY

The disclosure makes it possible to improve the prior art by proposing an electronic switch for simulating a mechanical rocker switch having a determined current-interrupting capacity, the electronic switch being configured to supply power to an electronic device consuming a load current less than or equal to said determined interrupting capacity, using an input voltage, the electronic switch comprising:

- a tact switch for the generation of a control signal,
- a bistable circuit whose output state depends on the control signal,
- a switching circuit adapted to the opening and to the closing of a power supply line supplying power to a device consuming a current less than or equal to the determined interrupting capacity, the switching circuit comprising a P-channel MOSFET transistor,
- a memory circuit comprising a reservoir capacitor, the tact switch being configured to control opening and closing of the switching circuit.

Advantageously, the electronic switch can maintain its "open" or "closed" state, as a simulated mechanical rocker switch would do, in the event of disappearance of the input voltage.

According to an embodiment, the memory circuit is adapted to the storage of an "open" or a "closed" mechanical position of the electronic switch for a predetermined duration according to the value of the reservoir capacitor.

According to an embodiment, the current-interrupting capacity of the tact switch is much less than the current-interrupting capacity of the electronic switch.

According to an embodiment, the electronic switch simulating a mechanical switch is configured to store autonomously the mechanical position of the simulated switch for the predetermined duration dependent on the value of the "memory" capacitor in the event of the disappearance of the input voltage.

LIST OF FIGURES

The disclosure will be better understood, and other specific features and advantages will emerge upon reading the following description, the description making reference to the annexed drawing:

FIG. 1 shows an electronic switch for simulating a mechanical rocker switch according to a particular and non-restrictive embodiment of the disclosure.

DETAILED DESCRIPTION OF EMBODIMENTS

In FIG. 1, the modules shown are functional units that may or may not correspond to physically distinguishable units. For example, these modules or some of them are grouped together in a single component, or constituted of functions of the same software. On the contrary, according to other embodiments, some modules are composed of separate physical entities.

FIG. 1 shows an electronic switch EPSW for simulating a mechanical rocker switch according to a particular and non-restrictive embodiment of the disclosure. The power switch circuit PS, comprising a P-channel MOSFET transistor QPSW, operates as a rocker switch connected between the input rail IR and the output rail OR and has an interrupting capacity PC1 equivalent to that of a rocker switch supplying power to the device SD (the simulated switch being located on the power supply rail) using an input voltage $V_{IC}$ applied to the input connector IC. Cleverly, and due to the assembly of the different elements which constitute it and notably to the presence of the memory circuit MC, the electronic switch EPSW is configured to store in the memory its "open" or "closed" position, corresponding to the position of the simulated mechanical rocker switch, for a duration T1 dependent on the value of the memory capacitor CM. Thus, if the input voltage $V_{IC}$ disappears then reappears, the electronic switch EPSW will be configured to "open" position if it was configured in this position before the disappearance of the input voltage and will be configured to "closed" position if it already was before the disappearance of the input voltage, provided that the input voltage did not disappear for a duration exceeding the maximum storage duration T1. Advantageously, the use of the P-channel MOSFET transistor QPSW enables an opening and a closing of the circuit on the power supply rail constituted of the association of the input rail IR and the output rail OR. This makes it possible, when the powered device SD is connected to earth via other items of equipment, to avoid the risk of constituting a line of floating or indefinite electric potential due to a remote connection to earth. Items of class 1 equipment have the ground of the power supply module connected to earth, which is not the case for items of class 2 equipment. A connection of the ground of the power supply to earth can notably exist in the case of electronic audiovisual programme cable network receiver devices, for example.

The very low interrupting capacity (a few tens of milliamperes maximum) tact switch TS components, and the capacitor C1 coupled to the resistor R1, constitute with the transistor Q1 and the capacitor C2 an input interface I-INT of the switch EPSW. The network RC constituted of the resistor R1 and of the capacitor C1 enables an anti-bounce filtering which guarantees a good shaping of the signal from the terminal not connected to the ground of the micro-switch TS. The capacitor C2 generates a delay in the control of a bidirectional switch BSW built around transistors Q2 and Q3, with respect to the assertion of the signal from the micro-switch TS. The bidirectional switch BSW enables the control of a power switch PS, built around the P-channel MOSFET transistor QPSW and which has a high interrupting capacity of several amperes. This control of the power switch PS is implemented via the intermediary of the transistor Q8 which constitutes an output interface O-INT of the electronic switch. A memory circuit MC built around the memory capacitor CM and the transistor Q6 coupled to a network constituted of the resistor R7 and of the capacitor C5 makes it possible to store the state of the output rail OR, taken via the diode D1. Thus, if the input voltage $V_{IC}$ disappears and reappears before the capacitor CM is discharged, the control of the bistable circuit BSW is implemented according to the state of the electronic switch before disappearance of the voltage $V_{IC}$. Advantageously, the electronic switch EPSW simulates a mechanical rocker switch since its state is retained even in the event of disappearance of the input voltage, and for a duration dependent on the discharge of the capacitor CM. The use of a MOSFET transistor makes it possible to have a high input impedance which limits the discharge current of the capacitor. Advantageously and according to the technology of the components used, the memory circuit MC is adapted to store the "open" or "closed" state of the electronic switch EPSW for around twenty days, without requiring the use of a microcontroller associated with a non-volatile memory.

The control line N-S-OFF makes it possible to control the electronic switch from an output port of a control unit. The signal line S1, together with the control line N-S-OFF, enables the reading of the state of operation of the electronic switch by an input of a control unit, if necessary, so that the system can be interfaced with a control unit.

The disclosure is not limited solely to the embodiment described but also applies to any circuit or electronic device operating as a switch controlled using a tact switch and configured to store its opening or closing state for a predefined time in the event of disappearance of the input voltage, so that the electronic switch simulates a mechanical rocker switch performing an opening and a closing of the power supply rail of a powered device. The electronic switch being characterised by an interrupting capacity much higher than the interrupting capacity of the tact switch used for control by the user. The order of magnitude of the ratio of the interrupting capacities being for example a factor of 100 or 1000.

The invention claimed is:

1. An electronic switch for simulating a mechanical rocker switch having a current-interrupting capacity, said electronic switch being configured to supply power to an electronic device consuming a current less than or equal to said interrupting capacity, using an input voltage, said electronic switch comprising:

a tact switch for the generation of a control signal, a bistable circuit whose output state depends on said control signal, a switching circuit adapted to an opening and to a closing of a power supply line supplying power to said electronic device, said switching circuit comprising a P-channel MOSFET transistor, a memory circuit comprising a reservoir capacitor, said tact switch being configured to control opening and closing of said switching circuit.

2. The electronic switch according to claim 1, wherein said memory circuit is adapted to a storage of an "open" or a "closed" mechanical position of said electronic switch for a duration according to said reservoir capacitor.

3. The electronic switch according to claim 1, wherein a current-interrupting capacity of said tact switch is less than said current-interrupting capacity of said electronic switch.

4. The electronic switch according to claim 1 being adapted to store autonomously said mechanical position of said simulated switch for said duration in an event of disappearance of said input voltage.

5. An electronic circuit for simulating a mechanical state-retaining switch, said electronic circuit being configured to supply power to an electronic device, using an input voltage, said electronic circuit comprising:

a tact switch for a generation of a control signal, a bistable circuit whose output state depends on said control signal, a switching circuit adapted to an opening and to a closing of a power supply line supplying power to said electronic device, said switching circuit comprising a semi-conductor switching element, said bistable circuit being configured to control said switching circuit wherein, said electronic circuit is adapted to maintain a state of said semi-conductor switching element during a disappearance then a reappearance of said input voltage.

6. The electronic circuit according to claim 5, wherein said tact switch has a current-interrupting capacity less than a current-interrupting capacity of said electronic circuit.

7. The electronic circuit according to claim 6, wherein said current-interrupting capacity of said tact switch is 100 or 1000 time less than said current-interrupting capacity of said electronic circuit.

8. The electronic circuit according to claim 5, wherein said electronic circuit is adapted to store autonomously a position of said mechanical state-retaining switch in an event of disappearance of said input voltage.

9. The electronic circuit according to claim 5, wherein said semi-conductor switching element is a P-channel MOSFET transistor.

10. The electronic circuit according to claim 5, wherein said electronic circuit comprises a memory circuit adapted to a storage of the opening or the closing of said power supply line when said input voltage disappears.

11. The electronic circuit according to claim 10, wherein said memory circuit is adapted to the storage of the opening or the closing of said power supply line for a duration depending on a discharge of a memory capacitor of said memory circuit.

12. The electronic circuit according to claim 10, wherein said electronic circuit is adapted to control said bistable circuit, during a disappearance then a reappearance of said input voltage, according to said stored opening or closing.

13. The electronic circuit according to claim 5, comprising an anti-bounce circuit.

14. The electronic circuit according to claim 5, wherein said supplied power is of DC type.

15. The electronic circuit according to claim 10, wherein said memory circuit is adapted to store the opening or the closing of said power line without requiring a use of a microcontroller associated with a non-volatile memory.

* * * * *